US006060426A

United States Patent [19]

Tan et al.

[11] Patent Number: 6,060,426

[45] Date of Patent: May 9, 2000

[54] THERMAL PAPER WITH SECURITY FEATURES

[75] Inventors: Yaoping Tan, Miamisburg; Maurice W. Lewis, Dayton; Bernard J. Jergens, Centerville, all of Ohio

[73] Assignee: NCR Corporation, Dayton, Ohio

[21] Appl. No.: 09/107,361

[22] Filed: Jun. 30, 1998

[51] Int. Cl.[7] ..... B41M 5/40

[52] U.S. Cl. ..... 503/200; 427/150; 427/152; 428/690; 503/207; 503/226

[58] Field of Search ..... 503/200, 209, 503/226, 207; 428/690; 427/150, 152

[56] References Cited

U.S. PATENT DOCUMENTS

| | | | |
|---|---|---|---|
| 4,150,997 | 4/1979 | Hayes | 106/15.05 |
| 4,153,593 | 5/1979 | Zabiak et al. | 260/29.6 ME |
| 4,328,332 | 5/1982 | Hayes et al. | 528/296 |
| 4,370,370 | 1/1983 | Iwata et al. | 428/40 |
| 4,388,362 | 6/1983 | Iwata et al. | 428/211 |
| 4,424,245 | 1/1984 | Maruta et al. | 428/40 |
| 4,444,819 | 4/1984 | Maruta et al. | 346/209 |
| 4,452,843 | 6/1984 | Kaule et al. | 428/199 |
| 4,507,669 | 3/1985 | Sakamoto et al. | 346/207 |
| 4,551,738 | 11/1985 | Maruta et al. | 346/200 |
| 4,598,205 | 7/1986 | Kaule et al. | 250/458.1 |
| 4,682,194 | 7/1987 | Usami et al. | 503/215 |
| 4,722,921 | 2/1988 | Kiritani et al. | 503/207 |
| 4,742,043 | 5/1988 | Tanaka et al. | 503/213 |
| 4,783,493 | 11/1988 | Motegi et al. | 524/13 |
| 4,942,150 | 7/1990 | Usami et al. | 503/213 |
| 5,292,855 | 3/1994 | Krutak et al. | 528/289 |
| 5,336,714 | 8/1994 | Krutak et al. | 524/608 |
| 5,397,819 | 3/1995 | Krutak et al. | 524/88 |
| 5,423,432 | 6/1995 | Krutak et al. | 209/577 |
| 5,461,136 | 10/1995 | Krutak et al. | 528/289 |
| 5,468,581 | 11/1995 | Coe et al. | 430/22 |
| 5,503,904 | 4/1996 | Yoshinaga et al. | 428/195 |
| 5,614,008 | 3/1997 | Escano et al. | 106/23 D |
| 5,665,151 | 9/1997 | Escano et al. | 106/31.5 |
| 5,682,103 | 10/1997 | Burrell | 324/642 |
| 5,703,229 | 12/1997 | Krutak et al. | 540/140 |

FOREIGN PATENT DOCUMENTS

| | | |
|---|---|---|
| 9308992 | 5/1993 | WIPO . |
| 9732733 | 9/1997 | WIPO . |

OTHER PUBLICATIONS

Database WPI, Section Ch, Week 9418, Derwent Publications Ltd., London, GB, Class G05, AN 94–147585, XP002103332 & JP 06 092074 A (Mitsubishi Paper Mills Ltd.), Apr. 5, 1994.

U.S. Patent Ser. application No. 09/153,588; filed Sep. 15, 1998, which is a CIP of U.S. Pat. Ser. application No. 09/107,362; filed Jun. 30, 1998, abandoned Sep. 15, 1998, entitled "Print Media with Near Infrared Fluorescent Sense Mark and Printer Therefor", by inventor Yaoping Tan et al., assigned to NCR Corporation.

U.S. Patent application Ser. No. 09/108,133, filed Jun. 30, 1998, entitled "Flexographic Security Ink with Near Infrared Fluorophores", by inventor Yaoping Tan et al., assigned to NCR Corporation.

*Primary Examiner*—Bruce H. Hess

*Attorney, Agent, or Firm*—Millen White Zelano & Branigan PC

[57] ABSTRACT

Thermosensitive recording materials, such as thermal papers, with near infrared flourescent (NIRF) compounds as a security feature and methods for preparing thermal papers with NIRF compounds as a security measure, wherein the NIRF compounds do not react with the reactive components of the thermosensitive recording materials and are preferably shielded from contact with ambient air.

25 Claims, No Drawings

THERMAL PAPER WITH SECURITY FEATURES

FIELD OF THE INVENTION

The present invention relates to security inks used to thwart counterfeiting of printed commercial documents such as sales transaction records and receipts. More particularly, the invention relates to the use of security features on thermosensitive recording materials such as thermal paper.

BACKGROUND OF THE INVENTION

Many different means of security are available to prevent duplication of printed commercial documents such as special papers (water marked paper) and special inks (fluorescent inks and other optically variable inks) which form latent images or images that change color.

The use of latent images as a security measure is well known. To be useful as a security measure, latent images must be well camouflaged but readily and easily viewable to the user, preferably by a simple procedure. An example of such a latent image is described in U.S. Pat. No. 5,468,581, which is formed when printing documents using an intaglio process. The latent image is overprinted on the visible image such that the latent image is visible when the document is tilted and viewed at an angle. The latent image is caused by the variation of the slight shadow from the raised ink pattern formed by the intaglio process or other printing method which produces raised ink patterns.

Optically variable inks have been used to provide latent images and images which change color when exposed to a light source other than ambient light. These optically variable inks allow for non-destructive testing of the security feature allowing the printing of such inks to be monitored. Such optically variable inks typically contain a fluorescent compound which responds to infrared or ultraviolet light. An example of an aqueous printing ink for jet printing which fluoresces under ultraviolet radiation is described in U.S. Pat. No. 4,153,593. The dyes described in this reference are water soluble and include fluorescein, eosine dyes and Rhodamine dyes. Representative disclosures of other inks include U.S. Pat. No. 4,328,332, issued to Hayes et al. on May 4, 1982, and U.S. Pat. No. 4,150,997, issued to Hayes on Apr. 24, 1979. While the use of fluorescent inks and dyes has been effective, with the advent of todays personal computers and color copiers, security measures relying on these optically variable inks have been overcome, particularly where records are only casually inspected, such as sales receipts and transaction records. Therefore, it is desirable to provide new means for forming latent images on printed commercial documents.

Krutak et al. describe the use of near infrared fluorescent (NIRF) compounds used in polyester-based and polyester-amide based coatings and ink compositions which are used for marking articles for identification/authentication purposes, in U.S. Pat. No. 5,292,855, issued Mar. 8, 1994, U.S. Pat. No. 5,423,432, issued Jun. 13, 1995, and U.S. Pat. No. 5,336,714, issued Aug. 9, 1994. Krutak et al. also disclose tagging thermoplastic containers and materials with near infrared flourescent compounds in U.S. Pat. No. 5,461, 136, issued Oct. 24, 1995, U.S. Pat. No. 5,397,819, issued Mar. 14, 1995, and U.S. Pat. No. 5,703,229, issued Dec. 30, 1997. The use of near infrared flourescent compounds as a security ink in thermal transfer printing has also been disclosed in International application WO 97/32733, published Sep. 12, 1997, wherein an image is formed by thermally transferring ink from a ribbon to paper.

Escano et al., U.S. Pat. Nos. 5,614,008 and 5,665,151, also disclose inks containing NIRF compounds.

Kaule et al., U.S. Pat. Nos. 4,452,843 and 4,598,205, disclose rare earth metal luminophores which absorb in the visible region and optionally the near-infrared region and can be excited in substantial portions of the visible or near IR-region.

Yoshinaga et al., U.S. Pat. No. 5,503,904, disclose recorded media with an invisible identification mark composed regions of high reflectance and low reflectance in the same near infrared region. Near infrared coloring materials are said to comprise xanthene, oxazine, thiazine, polymethine and stryl compounds.

Direct thermal paper is a thermosensitive recording material on which print or a design is obtained by the application of heat energy, without an ink ribbon. Thermal paper comprises a base sheet and a coating, and like other coated papers, the coating is applied to give new properties to the base sheet. However, a major distinction in thermal paper from other coated papers is that special color forming chemicals and additives are present in the coatings such that when heat is applied by a thermal head, the color forming chemicals react to develop the desired print or image.

The most common type of thermal coating is the dye-developing type system. The three main color producing components in a dye developing-type thermal paper are colorless dye (color former), a bisphenol or an acidic material (color developer) and sensitizer. These solid materials are reduced to very small particles by grinding and are incorporated into a coating formulation along with any optional additives such as pigments, binders and lubricants. This coating formulation is then applied to the surface of paper or other support system using various types of coating application systems and dried. Images are formed on the coated surfaces by the application of heat to melt and interact the three color producing materials.

Where security features from optically variable inks are desired for thermal paper, the optically variable inks must not pre-react the reactive components within the thermosensitive coating of the thermal paper to detract from the thermal papers printing performance. Certain chemicals can adversely affect and degrade the performance of the thermosensitive coating and should be avoided such as some organic solvents (ketones), plasticizers (polyethylene glycol type), amines (ammonia) and certain oils (soy oil). The coating solutions for NIRF compounds typically contain amines and other compounds which the thermosensitive coatings react with. It is desirable to provide a thermal paper with NIRF incorporated therein which does not result in pre-reacted components in the thermosensitive coating.

To protect thermal paper from environmental conditions, and premature coloration from handling, a number of developments have been made. One is to produce a barrier or protection layer on top of the thermal coating (see U.S. Pat. Nos. 4,370,370; 4,388,362; 4,424,245; 4,444,819; 4,507, 669; and 4,551,738). Another approach is to encapsulate the reactive components in microcapsules which rupture or are permeable when exposed to heat. See U.S. Pat. Nos. 4,682, 194; 4,722,921; 4,742,043; 4,783,493; and 4,942,150. These protection measures are not reliable in preventing premature coloration of the thermosensitive layer when exposed to a NIRF coating solution.

SUMMARY OF THE INVENTION

It is an object of the present invention to provide a thermal paper with a NIRF compound as a security feature to prevent counterfeiting.

It is another object of the present invention to provide a thermosensitive recording material, such as thermal paper, with a NIRF compound, as a security feature, wherein the NIRF compound is shielded from ambient air.

It is a further object of the present invention to provide a thermal paper with a NIRF compound as a security feature which is incorporated in the thermosensitive coating and does not pre-react the reactive components of said thermosensitive coating.

It is an additional object of the present invention to provide a thermal paper with a NIRF compound as a security feature which is deposited on the base layer, does not pre-react the thermosensitive coating and is shielded from reaction with oxygen in ambient air.

It is yet a further object of the present invention to provide a method for incorporating NIRF pigments as a security feature in thermal paper without premature coloration of the thermal paper, wherein the NIRF pigment is shielded from reaction with oxygen in ambient air.

Further objects and advantages of this invention will become apparent and further understood from the detailed description and claims which follow.

The above objects are achieved through thermosensitive recording materials such as thermal paper having a NIRF compound incorporated therein as a security feature. These thermosensitive recording materials comprise a base sheet or layer, a base coating on said base sheet, a thermosensitive coating on at least one surface of the base coating and a NIRF compound incorporated in:

a) the base sheet (paper substrate);

b) the base coating;

c) the thermosensitive (active) coating;

d) a separate top coating or back coating; or e) a combination of a)-d)

NIRF can be incorporated into any layer or separate NIRF layer.

Preferably, the NIRF compound is part of a dye or pigment shielded from ambient air so as not to react with the oxygen therein, and is also shielded from reaction with the reactive components of the thermosensitive coating. Such shielding preserves the NIRF compounds and the thermosensitive coating of the thermal paper so that it will still generate color when exposed to heat.

The NIRF dyes and pigments provide a unique mode of security through the unique wavelength of radiation to which the NIRF dyes and pigments respond. Inks which provide images with additional modes of security, such as additional fluorescent dyes which respond at wavelengths in the UV or usable light range or water-proof polymers for pseudo-water marks can also be used.

In another aspect of the present invention, there is provided a method of preparing thermal paper having a NIRF pigment incorporated therein as a security feature. This method comprises forming NIRF pigment particles and either coating a base sheet with said pigment particles and overcoating the pigment particles with a base coating or thermosensitive layer or incorporating the NIRF pigment particles directly in the thermosensitive layer. The coatings can be applied by conventional coating processes.

The thermal papers of the present invention have a base sheet or layer with at least one surface coated with a conventional base coating followed by a thermosensitive coating. The base coating is typically comprised of inert clays and provides a smooth surface for the thermosensitive coating. This thermosensitive coating is preferably of the dye-developing type. Particularly suitable dye developer systems are those wherein the reactive dyes are colorless or white-colored which become dark colored when melted and exposed to a color developer. Such dyes are typically basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. One skilled in the art can readily determine the melting point necessary for a desired application and select a dye and developer accordingly, or select a conventional thermal paper with a thermosensitive coating on one side. A well known dye is that identified in the art as "ODB-II". A preferred color developer is bisphenol A and a preferred sensitizer is M-terphenyl.

Color formers suitable for use in the coating formulations in thermosensitive recording materials of this invention are leuco dyes. Leuco dyes are colorless or light colored basic substances, which become colored when oxidized by acidic substances. Examples of leuco dyes that can be used herein are described as follows:

a) Leuco bases of triphenylmethane dyes represented by formula I:

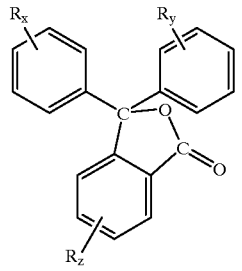

wherein $R_x$, $R_y$, and $R_z$ , of general formula I can be, independently of each other, hydrogen, hydroxyl, halogen, $C_1$–$C_6$ alkyl, nitro or aryl. Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phatalide.

(b) Leuco bases of fluoran dyes represented by formula II:

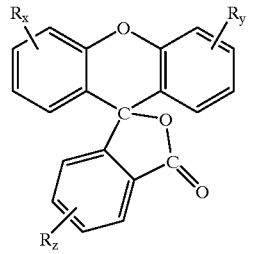

wherein $R_x$, $R_y$, and $R_z$ of formula II are as defined above for formula I. Some examples are: 3-cyclohexylamino-6-chlorofluoran, 3-(N-N-diethylamino)-5-methyl-7-(N,N-

Dibenzylamino)fluoran, 3-dimethylamino-5,7-dimethylfluoran and 3-diethylamino-7-methylfluoran.

(c) Other suitable fluoran dyes include: 3-diethylamino-6-methyl-7-chlorofluoran, 3-pyrrolidino-6-methyl-7-anilinofluoran, and 2-[3,6-bis(diethylamino) -9-(0-chloroanilino)xanthybenzoic acid lactam].

(d) Lactone compounds represented by formula III:

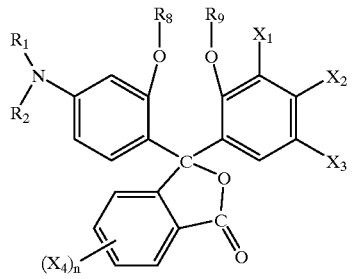

wherein $R_1$, and $R_2$ of formula III, independently of each other, represent hydrogen, unsubstituted $C_1$–$C_6$ alkyl, substituted $C_1$–$C_6$ alkyl, substituted phenyl, unsubstituted phenyl, cyanoethyl, β-halogenated ethyl, or $R_1$ and $R_2$ in combination form a cyclic structure and represent —$(CH_2—)_4$, $(—CH_2—)_5$ and at least one of $R_8$, and $R_9$ is hydrogen and the other is hydrogen, $C_1$–$C_6$ alkyl, aralkyl, amyl, or phenyl; $X_1$, $X_2$ and $X_3$ each, independently of each other, represent hydrogen, $C_1$–$C_6$ alkyl, halogen, halogenated methyl, nitro, amino or substituted amino and $X_4$ represents hydrogen, $C_1$–$C_6$ alkyl or $C_1$–$C_6$ alkoxy and n is an integer of from 0 to 4. Specific examples of the above-mentioned compounds are: 3-(2'-hydroxy-4'-dimethylaminophenyl)-3-(2'[-methoxy-5'-chlorophenyl) phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl) phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermal sensitive recording materials of this invention are phenol compounds, organic acids or metal salts thereof and hydroxybenzoic acid esters.

Preferred color developers are phenol compounds and organic acids which melt at about 50° C. to 250° C. and are sparingly soluble in water. Examples of phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel. Some of the color developers are 2,2,-bis(4'-hydroxyphenyl)propane (Bisphenol-A), p-phenylphenol, 2,2-bis(4'-hydroxyphenyl)-n-heptane and 4,4'-cyclohexylidene phenol.

Sensitizers or thermosensitivity promoter agents are used in the coating formulation and thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction to take place with ease at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

The thermosensitive coating compositions can be applied to any conventional base sheet or layer suitable for use in thermal paper. The base sheet or layer must not contain any reactive elements which would prematurely color the thermosensitive coating. The thermosensitive coating can vary in composition, as is conventionally known in the art, including the encapsulation of components therein and the use of protective layers thereon to prevent premature coloration during handling. The thermosensitive coatings can also be applied by conventional methods using conventional equipment.

The NIRF compounds employed in the thermal recording media and methods of the present invention provide a security measure that is responsive to wavelengths in the near infrared region of 650 nm to 2500 nm. The NIRF compounds need not absorb or transmit visible light under ambient indoor conditions or when illuminated. Preferably, they are transparent or invisible to the naked human eye under ambient light.

Preferred NIRF compounds, used in the form of dyes or pigments, have excellent thermal stability and little light absorption in the visible light region, i.e., they impart little or no color to the coatings and substrates (thermal papers) to which they are applied. These compounds have strong absorption of near infrared light (high molar extinction coefficients, e.g., >2000), and have strong fluorescence in the near infra-red over the wavelengths of about 670 nm to 2500 nm. They are preferably stable to sunlight and fluorescent light. The NIRF pigments and dyes are also preferably soluble, dispersible or emulsifiable in water to provide "water-based" formulations.

Suitable NIRF pigments and dyes include those described in U.S. Pat. Nos. 5,292,855; 5,423,432; 5,336,714; 5,461,136; 5,397,819; 5,703,229; 5,614,088; 5,665,151 and 5,503,904. The NIRF pigment or dye employed may depend on the equipment used to apply the NIRF compound to the base sheet/layer.

Suitable NIRF compounds are selected from the classes of phthalocyanines, naphthalocyanines, squaraines and correspond to Formulae II, III and IV:

(II)

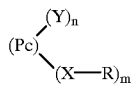

(III)

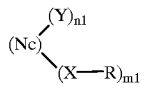

-continued (IV)

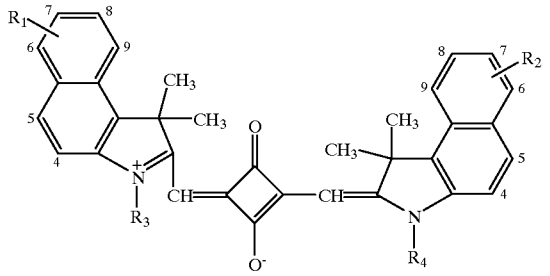

wherein Pc and Nc represent the phthalocyanine and 2,3-naphthalocyanine moieties of Formulae IIa and IIIa.

IIa

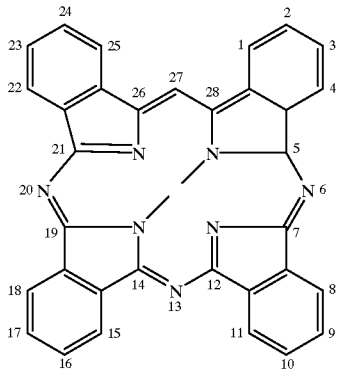

IIIa

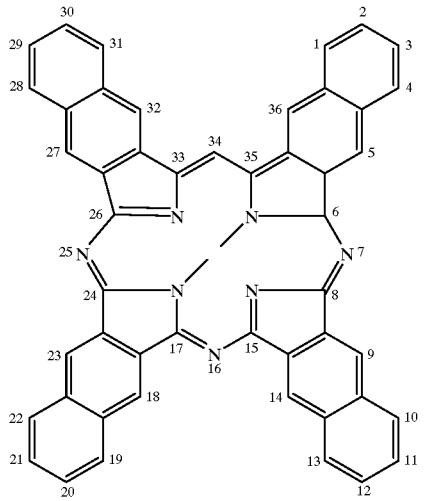

respectively, covalently bonded to various halometals, organometallic groups, and oxymetals, preferably aluminum and silicon based, including AlCl, AlBr, AlF, $AlOR_5$, $AlSR_5$, $SiCl_2$, $SiF_2$, $Si(OR_6)_2$, or $Si(SR_6)_2$.

$R_5$ and $R_6$ of these aluminum and silicon based groups are selected from hydrogen, alkyl, aryl, heteroaryl, lower alkanoyl, arylcarbonyl, arylaminocarbonyl, trifluoroacetyl, groups of the formulae

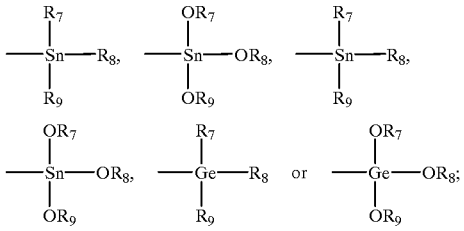

$R_7$, $R_8$ and $R_9$ of these Sn and Ge groups are independently selected from alkyl, phenyl or phenyl substituted with lower alkyl, lower alkoxy or halogen;

X of formulae II and III is selected from oxygen, sulfur, selenium, tellurium or a group of the formula N-$R_{10}$, wherein $R_{10}$ is hydrogen, cycloalkyl, alkyl, acyl, alkylsulfonyl, or aryl or $R_{10}$ and R taken together form an aliphatic or aromatic ring with the nitrogen atom to which they are attached;

Y of formulae II and III is selected from alkyl, aryl, heteroaryl, halogen or hydrogen;

R of formulae II and III is selected from hydrogen, unsubstituted or substituted alkyl, alkenyl, alkynyl, $C_3$–$C_8$ cycloalkyl, aryl, heteroaryl, alkylene,

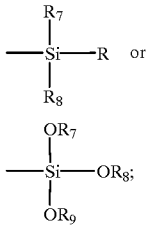

Alternatively, —(X—R)$_m$ is one or more groups selected from alkylsulfonylamino, arylsulfonylamino, or a group selected from the formulae —X($C_2H_4O$)$_z$R, wherein R is as defined above; Z is an integer of from 1–4;

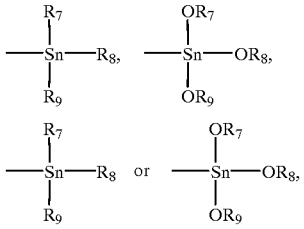

In addition, or two —(X—R)$_m$ groups can be taken together to form divalent substituents of the formula

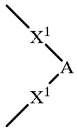

wherein each $X^1$ is independently selected from —O—, —S— or —N—$R_{10}$ and A is selected from ethylene, propylene, trimethylene, and such groups substituted with $C_1$–$C_4$ alkyl, $C_1$–$C_4$ alkoxy, aryl and cycloalkyl, 1,2-phenylene and 1,2-phenylene containing 1–3 substituents selected from $C_3$–$C_4$ alkyl, $C_1$–$C_4$ alkoxy or halogen.

For formulae II and III, $m_1$ is an integer from 0–24; provided that the sums of n+m and $n_1$ and $m_1$ are 16 and 24, respectively.

$R_1$ and $R_2$ of formula IV are independently selected from hydrogen, lower alkyl, lower alkoxy, halogen, aryloxy, lower alkylthio, arylthio, lower alkylsulfonyl; arylsulfonyl; lower alkylsulfonylamino, arylsulfonylamino, cycloalkylsulfonylamino, carboxy, unsubstituted and substituted carbamoyl and sulfamoyl, lower alkoxycarbonyl, hydroxy, lower alkanoyloxy,

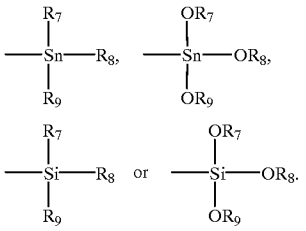

$R_3$ and $R_4$ of formula IV are independently selected from hydrogen, lower alkyl, alkenyl or aryl, n is an integer from 0–16; $n_1$, is an integer from 0–24, m is an integer from 0–16.

The NIRF compounds of formulae II, III and IV can be prepared by conventional methods.

In the above formulae, the phthalocyanine and 2,3-naphthalocyanine compounds of formula IIa and IIIa may also be covalently bound to a hydrogen, AlOH, Ca, CO, CrF, Cu, Fe, Ge, Ge($OR_6$), InCl, Ni, Ga, Mg, Mn, Pb, Pt, Pd, $SnCl_2$, Sn, Si$(OR)_2$, Sn$(OR6)_2$, TiO, VO, Zn and others, as described in U.S. Ser. No. 789,570, filed Nov. 8, 1991, which is a grandparent application of U.S. Pat. No. 5,461,136.

For the terms "alkyl", "lower alkyl", "lower alkoxy", "lower alkylthio", or "lower alkoxy carbonyl", "lower alkanoyl", "lower alkanoyloxy"; the "alkyl" portion represents 1–6 carbon atoms, which can be substituted by hydroxy, halogen, carboxy, cyano, alkoxy and aryl. "Cycloalkyl" represents 3–8 cyclic carbon atoms; "aryl" represents 6–18 aromatic carbon atoms; "heteroaryl" represents 2–17 cyclic carbon atoms with at least one oxygen, sulphur, nitrogen or a combination thereof, "alkenyl" and "alknyl" represent 3–8 carbon atoms with at least one double bond; "halogen" represents Br, Cl, F or I; "substituted carbamoyl" and "substituted sulfamoyl" represent $CONR_{12}R_{13}$ and —$SO_2NR_{12}R_{13}$, respectively, where $R_{12}$ and $R_{13}$ represent alkyl, alken alkynyl, cycloalkyl, aryl and heteroaryl, and "acyl" represents $R_{15}C(O)$—O—, wherein $C_{15}$ is alkyl.

Preferably, m is from 4–12 and $m_1$ is from 0–8 for formulae II and III. Other preferred compounds include the squaraine compounds of formula IV, wherein $R_1$ and $R_2$ are independently carboxy or lower alkoxy carbonyl; a 2,3-naphthalocyanine compound of formula III, wherein Y is hydrogen, $n_1$ is 24, and $m_1$ is 0; a 2,3-naphthalocyanine compound of formula III, wherein the naphthalocyanine moiety is bonded to $SiCl_2$, $Si(OH)_2$, or Si$(OR_6)_2$ ; and a phthalocyanine compound of formula II, wherein X is oxygen, R is aryl, Y is hydrogen, m is 4, and n is 12; and wherein the phthalocyanine moiety is bonded to AlCl, AlOH, $AlOCOCF_3$, $AlOR_5$, $SiCl_2$, $Si(OH)_2$, or Si$(OR_6)_2$. Other preferred compounds are described in Examples 1–41 of U.S. Pat. No. 5,461,136, incorporated by reference herein.

The NIRF compound does not cause premature reaction of the thermosensitive layer. Preferably, the NIRF compound is shielded from ambient air to prevent reaction with oxygen. The NIRF compound can be shielded by incorporating the compound in pigment particles, applying a protective coating on the layers formed with such compounds, or both.

The NIRF compounds are incorporated into security inks in the form of NIRF dyes (solution) or NIRF pigments (solid). The NIRF dyes comprise NIRF compounds in solution, preferably in aqueous solutions as discussed above. The NIRF pigment particles are solids and comprise a polymer or copolymer which is either admixed with NIRF compounds or the NIRF compounds are copolymerized with other active monomers, oligomers or polymers to form a copolymer.

The active monomers, oligomers or polymers typically have at least one reactive group selected from the formulae $$—OCOR_{14}, —OCO_2R_{14}, OCONHR_{14} \text{ or } —CO_2R_{14},$$

wherein $R_{14}$ is selected from unsubstituted or substituted alkyl, cycloalkyl or aryl radicals, $R_{14}$ preferably is unsubstituted alkyl, e.g., alkyl of up to about 8 carbons, or phenyl, and most preferably lower alkyl, e.g., methoyl and ethyl. The reactive group preferably is hydroxy, carboxy, carbomethoxy, carboethoxy or acetoxy. The monomers and oligomers contain 1 to about 8 reactive groups, preferably 2. The polymers may contain more. The NIRF compounds are added at such low levels that they do not significantly interfere with the polycondensation reaction of these active species.

The coating formulations containing NIRF pigments can have a solids content which ranges widely such as from 20 to 80 wt. % which includes the NIRF compound and the carrier polymer or copolymer components. For flexographic printing, a solids content of from 40–60 wt. % is preferred for conventional flexographic printers such as those provided by Wolverine and Mark Andy. Pigment concentrates are often prepared and diluted with polymer resin to achieve preferred levels of NIRF compounds.

Coating formulations containing (security inks) NIRF dyes typically have lower solids contents but a higher proportion of the solids comprise NIRF compounds.

The concentration of the NIRF compound within the security inks used to form the thermal papers of this invention can vary over wide limits. In general, an optical effect can be developed on most thermal papers with a NIRF compound present within the security inks in an amount as low as 0.01 ppm based on the total weight of solids (dry components). It is generally desirable that the NIRF compound be present at the lowest practical level needed to produce an ink with a satisfactory fluorescence detection level to avoid interference form other colors and to minimize costs. Preferably, the amount of NIRF compound within the ink used falls within the range of 0.1 ppm to 1000 ppm, based on dry components of the security ink. Typical amounts fall within the range of 0.5 ppm to 300 ppm, with amounts of 1 ppm to 100 ppm often being most preferred.

Apparatus used to detect the presence of NIRF compounds include any apparatus capable of detecting fluorescence, i.e., photons emitted by dyes and pigments at wavelengths in the range of about 670 nm to 2,500 nm. These photon detectors include photomultiplier tubes, solid state detectors, semiconductor based detectors and similar devices. Silicon photodiodes or germanium detectors are specific examples of suitable photon detectors. Filters may be used to restrict the wavelengths which impinge the detector.

Devices which irradiate the NIRF compounds with near infra-red radiation include laser diodes, light emitting diodes, solid state lasers, dye lasers, incandescent light sources and other light sources which emit radiation at a wavelength in the range of 670–2500 nm. Preferred light sources are those which have a maximum signal at the maximum of the absorbence of the NIRF compound. Filters may be used to restrict the wavelengths which irradiate the NIRF compounds.

The polymers admixed with NIRF pigments or copolymerized therewith are preferably polyesters, polycarbonates or polyurethanes and are used in an amount sufficient to render the NIRF pigments waterproof.

The diol components of the polyester may be comprised of, for example, ethylene glycol, 1,4-cyclohexanedimethanol, 1,2-propanediol, 1,3-propanediol, 2-methyl-, 1,3-propanediol, 1,6-hexanediol, 1,2-cyclohexanediol, 1,4-cyclohexanediol, 1,10-decanediol, 1,2-cyclohexanedimethanol, 1,3-cyclohexanedimethanol, X,8-bis-(hydroxymethyl)-tricyclo-[5.2.1.0]-decane wherein X represents 3, 4, or 5; and diols containing one or more oxygen atoms in the chain, e.g., diethylene glycol, triethylene glycol, dipropylene glycol or tripropylene glycol and the like. In general, these diols contain 2 to 18, preferably 2 to 12 carbon atoms. Cycloaliphatic diols can be employed in their cis or trans configuration or as a mixture of both forms.

The acid components (aliphatic, alicyclic, or aromatic dicarboxylic acids) of the polyester may be comprised of, e.g., terephthalic acid, naphthalene-2,6-dicarboxylic acid, isophthalic acid, 1,4-cyclohexanedicarboxylic acid, 1,3-cyclohexane dicarboxylic acid, succinic acid, glutaric acid, adipic acid, sebacic acid, 1,2-dodecanedioic acid and the like. In place of the dicarboxylic acids themselves, it is possible and often preferable to use a functional acid derivative thereof such as the dimethyl, diethyl or dipropyl ester of the dicarboxylic acid. The anhydides of the dicarboxylic acids can likewise be employed. The polyesters can be produced using typical polycondensation techniques well known in the art. Polycarbonates useful in the practice of the invention are disclosed in *Kirk-Othmer Encyclopedia of Chemical Technology*, third edition, Vol. 18, pp. 479–494.

A NIRF pigment concentrate may be formed which comprises a NIRF compound of formula II, III or IV above, polymerized in a partially crystalline polyester at a level of from 0.1 to 30.0 wt. %, preferably 0.1 to about 10.0 wt. %. These copolymers preferably have at least two reactive groups. This concentrate can be used as a powder or pellet admixed with a desired polyester or other thermoplastic polymer. The concentrate may be dry blended or solution blended with additional resin. Suitable polyesters are linear thermoplastic crystalline or amorphous polymers.

A wide range of thermoplastic polymers suitable for blending with the above condensation polymers which contain the NIRF compounds are known in the art and includes polyesters, e.g., poly(ethylene terephthalate) and poly (butylene terephthalate); polyolefins, e.g., polypropylene, polyethylene, linear low density polyethylene, polybutylene and copolymers made from ethylene, propylene and/or butylene; polyamides, e.g., nylon 6 and nylon 66; polyvinyl chloride, polyvinylidene chloride; polycarbonates; cellulose esters, e.g., cellulose acetate, propionate, butyrate or mixed esters; polyacrylates, e.g., poly(methyl methacrylate); polyimides; polyester-amides; polystyrene; ABS (acrylonitrile-butadiene-styrene)type polymers, and (TPO) thermoplastic oligomers, etc.

The security inks may contain additives such as wax and resin binders discussed below, as well as pH stabilizers, UV stabilizers, surfactants, colored pigments, defoamers and plasticizers. The nature of these additives will depend on the end use.

The security inks containing NIRF dyes or NIRF pigments preferably comprise an aqueous based carrier so as not to pre-activate the thermosensitive layer. The carrier can comprise an aqueous solution with or without a water soluble, dispersible or emulsifiable organic solvent which does not activate the thermal paper. The aqueous based carrier may contain a dispersing agent to help solubilize the NIRF pigment or dye within the security ink. The security ink is preferably dried on the thermal paper by the evaporation of water and any other volatile components within the aqueous based carrier to leave a solid layer. The binder compounds of the carrier and the amount thereof can vary widely, depending on the method intended to be employed for depositing the security ink on the base layer. For example, the amount of carrier (water) used can vary from 15 to 70 wt. % based on the total weight of the security ink containing the NIRF dye or pigment.

The water based security inks used on the thermal papers of this invention may comprise a water emulsifiable or dispersible wax and/or a water soluble, emulsifiable or dispersible thermoplastic resin binder component. The waxes can be natural waxes, including Carnauba wax, candelilla wax, beeswax, rice bran wax, petroleum waxes such as paraffin wax, synthetic hydrocarbon waxes such as low molecular weight polyethylene and Fisher-Tropsch wax, higher fatty acids such as myristic acid, palmitic acid, stearic acid and behenic acid; higher aliphatic alcohols such as steryl alcohol and esters such as sucrose fatty acid esters. Mixtures of waxes can also be used. To aid in the dispersion of the wax within an aqueous medium, micronized grades of wax are preferred.

Water soluble, dispersible or emulsifiable resins suitable as binders include thermoplastic resins such as polyvinyl chloride, polyvinyl acetate, vinyl chloride-vinyl acetate copolymers, polyethylene, polypropylene, polyacetal, ethylene-vinyl acetate copolymer, ethylenealkyl(meth) acrylate copolymer, ethylene-ethylacetate copolymer, polystyrene, styrene copolymers, polyamide, ethylcellulose, epoxy resin, polyketone resin, polyurethane resin, polyvinylbutryl, styrenebutadiene rubber, nitrile rubber, acrylic rubber, ethylene-propylene rubber, ethylene alkyl (meth)acrylate copolymer, styrene-alkyl(meth)acrylate copolymer, acrylic acid-ethylene-vinylacetate terpolymer, saturated polyesters and sucrose benzoate. To obtain emulsions of polymers which are insoluble or partially soluble in water, the resin is typically ground to submicron size.

Thermal papers which contain a NIRF compound can be prepared by printing or coating the security ink on the base sheet/layer or thermosensitive coating of the thermal paper using conventional equipment and coating techniques. Examples include those of relief printing, offset printing, flexography, lithography and silkscreening. Flexographic printing equipment is preferred, particulary where other indicia are printed on the thermal paper by flexographic printing. Where the security ink is applied to a base sheet/layer of a thermal paper, the printing or coating operation/procedure is not limited by temperature. Where the security ink is deposited on the thermosensitive coating, only methods which do not require the application of high temperatures can be used. Once the security ink is applied to the thermosensitive coating, it is dried at temperatures preferably less than 65° C., most preferably at ambient temperature.

In preferred methods, NIRF pigments are used within the security ink which is applied to the base sheet/layer and overcoated with the base coating or thermosensitive layer of the thermal paper. Where the security ink is applied to the back side of the thermal paper, the deposited ink is overcoated with a protective water-proof coating. Such a coating may also be applied to security inks deposited on the front side of the thermal paper, either before or after application of the thermosensitive layer.

An alternative embodiment is to incorporate the security ink in the coating formulation for the thermosensitive coating. The thermosensitive layer with NIRF compounds incorporated therein can be applied to the base sheet with conventional equipment and printing methods.

To provide the security ink, the components are typically combined as dispersions at about 30 wt. % solids in a ball mill or similar conventional grinding equipment and agitated and ground. Where a wax emulsion is used, it is typically the initial material and the remaining components are added thereto with minor heating.

Without further elaboration, it is believed that one skilled in the art can, using the preceding description, utilize the present invention to its fullest extent. The entire disclosure of all applications, patents, publications, cited above and below, are herein incorporated by reference.

EXAMPLES

Example 1

Thermal papers consisting of substrate paper, base coat and active (thermosensitive) coat are prepared. The thermal papers prepared can be subsequently treated with a top coat for protection of the active coat against environmental forces, and a backcoat to provide curl control and antistat.

The base coat (40% solids) comprises conventional base coat components such as clays/binders to produce a level surface for the active coat and additionally comprises 0.5–5 wt. % NIRF powder based on total solids.

The active coat comprises conventional active coat components such as dye, coreactant, sensitizer and stabilizer. A conventional thermosensitive coating is used with dye ODB-2 and bisphenol coreactant and sensitizer. The ODB-2 dye needs to be ground for 2 hours separately from the coreactant and sensitizer in order to avoid premature reaction during the grinding process.

Blending of the Reactive Coating

The dye grind (38% solids) and bisphenol grind (41% solids) are aged for a minimum of 12 hours, then mixed together for a minimum of 0.5 hr. before using on the coater applicator.

Applicating Process

1. Apply base coat to paper substrate.

2. Apply active coat to the top of base coat.

Example 2

Coating formulations of NIRF T4 780 at concentrations of 300 and 600 ppm are prepared using 3000 ppm and 6000 ppm NIRF T4 780 concentration polymers, respectively. The NIRF T4 pigments are dispersed into acrylic overprint varnish and the solids adjusted to 44% in water. The viscosity of both inks is 23 seconds in a Zahn Cup #2 (X24429–187 and X24429–188B).

Printing on Thermal Paper

The two inks are printed on Kanzaki F-380 thermal paper and No. 15 bond paper, respectively, using a Mark Andy 830 Flexo press, as discussed above. A rubber metering roll is used to supply and meter inks to an Anilox roll, from which the ink is transferred to a rubber plate. The Anilox roll comprise ceramic 300 lines (10 BCM) and 400 lines (7 BCM), respectively. The line speed is 100 feet per minute and drying is accomplished employing a quartz lamp as a heat source. The NIRF compound is detected on the papers both during and after the press run.

Example 3

The coating formulations described in Example 2 (NIRF T4 780) are coated on various types of paper, both front and back with the Marc Andy Flexo press discussed above with an Anilox roller 300 with 10 BCM rollers. The coating formulations are printed on the following papers at a press speed of 200 feet per minute, as 2" wide strips traveling with the web at a length of 14".

1. 3-S tablet
2. T-1012A and b 3. Enviro 100,

The NIRF compounds on each paper were sensed during printing.

Example 4

Two sets of five colors bars (¾" tall and 13" wide) are applied to the various papers of Example 3, as set forth below in Table A.

Set #1

1. Pantone Green
2. Pantone Black
3. Pantone Cyan
4. Pantone Violet
5. PMS 348

Set #2.

1. Reflex Blue
2. PMS 185
3. PMS 347
4. PMS 469
5. PMS 165.

TABLE A

| NIRF Position | Paper | Set # |
|---|---|---|
| 1. Front | 3-S | 1 |
| 2. Back | 3-S | 1 |
| 3. Front | T-1012 | 1 |
| 4. Back | T-1012 | 1 |
| 5. Back | E-100 | 1 |
| 6. Front | E-100 | 1 |
| 7. Back | 3-S | 2 |
| 8. Front | 3-S | 2 |
| 9. Back | T-1012 | 2 |
| 10. Back | T-1012 | 2 |
| 11. Front | E-100 | 2 |
| 12. Back | E-100 | 2 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermosensitive recording material comprising a base sheet, a base-coating and thermosensitive coating on one surface of said base coating and a near infra-red fluorescent (NIRF) compound which is incorporated in a) said base-coating, b) said thermosensitive coating, c) a separate top coating or back coating, d) said base sheet, or e) a combination of a), b), c) and d);

wherein the amount of NIRF compound within the thermosensitive recording material is sufficient to be sensed by a photon detector operating in the near infra-red region of 650 nm to 2,500 nm, does not cause premature reaction of the thermosensitive coating components and is shielded from ambient air to prevent reaction with oxygen by either i) incorporating said NIRF compound within a solid pigment particle comprised of a polymer resin.

ii) applying at least one protective coating over the thermosensitive coating, the separate top coating or back coating, or base layer within which said NIRF compound is incorporated, or iii) employing a combination of i) and ii).

2. A thermosensitive recording material as in claim 1, wherein the NIRF compound is incorporated within a solid pigment particle comprised of a polymer resin.

3. A thermosensitive recording material as in claim 2, wherein the solid pigment particles comprise NIRF compounds admixed into a polymer which is not water soluble.

4. A thermosensitive recording material as in claim 2, wherein the solid pigment particles comprise copolymers of NIRF compounds copolymerized with monomers, oligomers and/or polymers, wherein said copolymer of NIRF compounds is not water soluble.

5. A thermosensitive recording material as in claim 1, wherein the NIRF compound is incorporated in said base sheet and said base coating and thermosensitive coating are positioned over a surface of said base sheet.

6. A thermosensitive recording material as in claim 1, wherein the NIRF compound is deposited on a surface of said base sheet and said base coating and thermosensitive coating are positioned over the surface of said base sheet upon which the NIRF compound is deposited.

7. A thermosensitive recording material as in claim 1, wherein the NIRF compound is incorporated in said base coating which is coated on said base sheet and said thermosensitive coating is positioned over the surface of said base coating.

8. A thermosensitive recording material as in claim 1, wherein the NIRF compound is incorporated in a separate top coating deposited directly on said thermosensitive coating or a separate back coating deposited on the back of said base sheet.

9. A thermosensitive recording material as in claim 8, wherein the separate coating containing NIRF compound is overcoated by said thermosensitive coating.

10. A thermosensitive coating as in claim 8, wherein the NIRF compound is incorporated within solid micron size pigment particles comprised of polymers which are not soluble in water.

11. A thermosensitive recording material as in claim 10, wherein the polymers are selected from the group consisting of polyesters, polyurethanes and polycarbonates, and varnishes derived from natural and synthetic resin.

12. A thermosensitive recording material as in claim 1, wherein the NIRF compound is incorporated in a separate coating deposited on the top surface of said thermosensitive coating.

13. A thermosensitive recording material as in claim 1, wherein the NIRF compound is invisible to the naked eye under illumination with a 60 watt incandescent light bulb.

14. A thermal paper as in claim 1, wherein the NIRF compound is incorporated in a separate coating or the thermosensitive coating in an amount ranging from 0.01 ppm to 1000 ppm, based on the total weight of dry components of the coating in which it is incorporated.

15. A thermal transfer paper as in claim 14, wherein the NIRF compound is selected from the group consisting of phthalocyanines, naphthalocyanines and squaraines that correspond to Formulae II, III and IV:

(II)

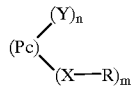

(III)

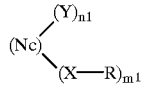

(IV)

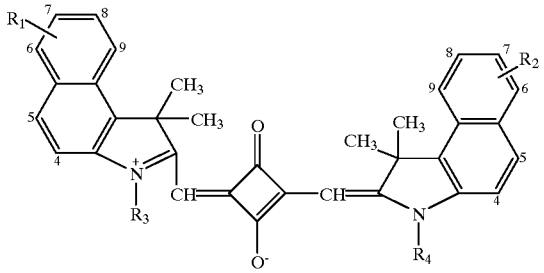

wherein Pc and Nc represent the phthalocyanine and 2,3-naphthalocyanine moieties of Formulae IIa and IIIa, IIa

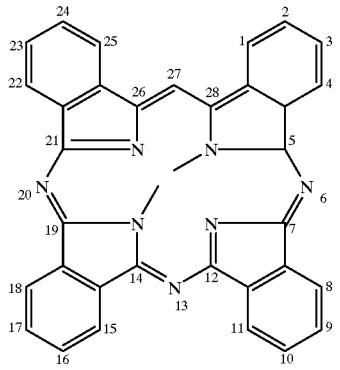

-continued

IIIa

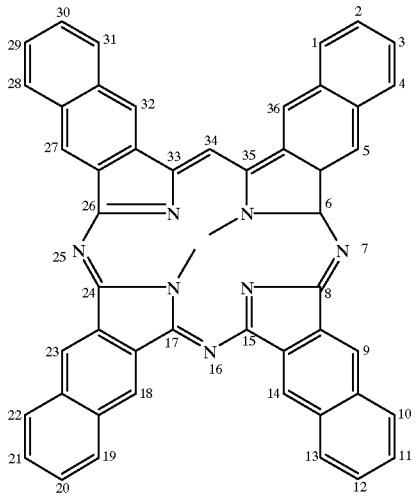

respectively, covalently bonded to aluminum or silicon groups selected from the group consisting AlCl, AlOH, $AlOCOCF_3$, $AlOR_5$, $SiCl_2$ and $Si(OR_6)_2$, wherein $R_5$ and $R_6$ are selected from the group consisting of hydrogen, alkyl, aryl, heteroaryl, lower alkanoyl arylcarbonyl, arylaminocarbonyl and trifluoroacetyl;

X is selected from the group consisting of oxygen;

Y is hydrogen;

R is selected from the group consisting of hydrogen, unsubstituted or substituted alkyl, alkenyl, alkynyl, $C_3$–$C_8$ cycloalkyl, and aryl;

n is an integer of from 0–16;

m is an integer of from 0–16;

$n_1$ is an integer of from 0–24;

$m_1$ is an integer of from 0–24, provided that the sum of n+m is 16 and the sum of $n_1+m_1$ is 24;

$R_1$ and $R_2$ are independently selected from the group consisting of hydrogen, lower alkyl, lower alkoxy, halogen, aryloxy, carboxy, lower alkoxycarbonyl and hydroxy; and $R_3$ and $R_4$ are independently selected from the group consisting of hydrogen, lower alkyl, alkenyl and aryl.

16. A thermal paper as in claim 15, wherein the NIRF compound is incorporated within solid pigment particles comprised of a polymer or copolymer of polyesters, polycarbonates or polyurethanes.

17. A thermal paper as in claim 16, wherein the NIRF compound is selected from the group consisting of phthalocyanines, wherein m is 4 and n is 1,2,3-naphthalocyanines, wherein $n_1$ is 24 and $m_1$ is 0, and squaraines wherein $R_1$ and $R_2$ are carboxy.

18. A thermosensitive recording material comprising a base sheet, a thermosensitive coating on a surface of said base sheet and a NIRF compound incorporated in said thermosensitive coating in an amount sufficient to be sensed by a photon detector operating in the near infra-red region of 650 nm–1500 nm, said NIRF compound being incorporated in a solid micron sized pigment particle which comprises a polymer admixed with the NIRF compound, a copolymer of the NIRF compounds copolymerized with monomers, oligomers or polymers, or both, wherein said NIRF compound does not cause premature reaction of the thermosensitive coating components and is shielded from ambient air to prevent reaction with oxygen by being incorporated in said solid micron sized pigment particle.

19. A thermosensitive recording material as in claim 1 which comprises a thermal paper.

20. A thermal paper as in claim 19, wherein the NIRF compound is selected from the group consisting of phthalocyanines, naphthalocyanines and squaraines that correspond to Formulae II, III and IV:

(II)

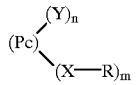

(III)

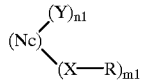

(IV)

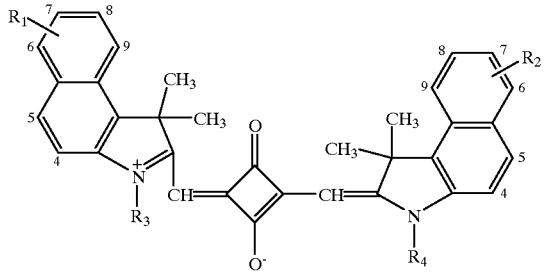

wherein Pc and Nc represent the phthalocyanine and 2,3-naphthalocyanine moieties of Formulae IIa and IIIa, IIa

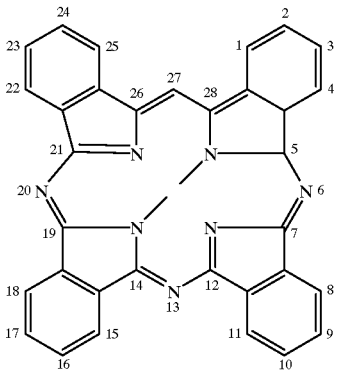

IIIa

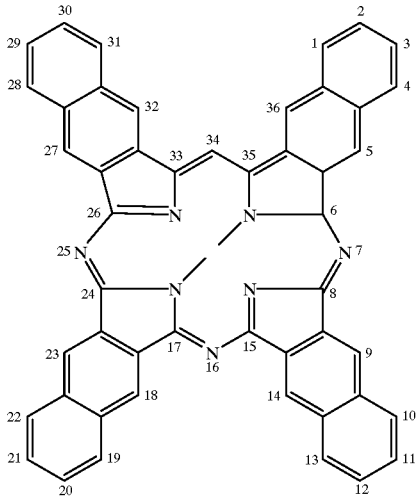

respectively, covalently bonded to aluminum or silicon containing groups selected from the group consisting of AlCl, AlBr, AlF, $AlOR_5$, $AlSR_5$, $SiCl_2$, $SiF_2$, $Si(OR_6)_2$, or $Si(SR_6)_2$, wherein $R_5$ and $R_6$ are selected from the group consisting of hydrogen, alkyl, aryl, heteroaryl, lower alkanoyl, arylcarbonyl, arylaminocarbonyl, trifluoroacetyl and groups of the formulae

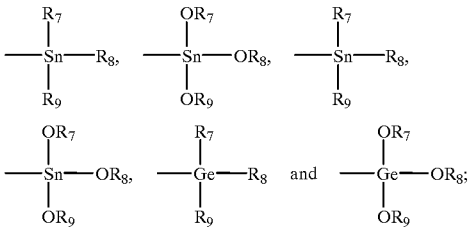

$R_7$, $R_8$ and $R_9$ are independently selected from the group consisting of alkyl, phenyl or phenyl substituted with lower alkyl, lower alkoxy or halogen;

X is selected from the group consisting of oxygen, sulfur, selenium, tellurium and a group of the formula N-$R_{10}$, wherein $R_{10}$ is hydrogen, cycloalkyl, alkyl, acyl, alkylsulfonyl, or aryl or $R_{10}$ and R taken together form an aliphatic or aromatic ring with the nitrogen atom to which they are attached;

Y is selected from the group consisting of alkyl, aryl, heteroaryl, halogen and hydrogen;

R is selected from the group consisting of hydrogen, unsubstituted or substituted alkyl, alkenyl, alkynyl, $C_3$–$C_8$ cycloalkyl, aryl, heteroaryl, alkylene

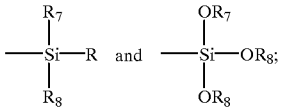

or —(X—R)$_m$ is one or more groups selected from the group consisting of alkylsulfonylamino, arylsulfonylamino, —X($C_2H_4O$)$_z$R, wherein R is as defined above; Z is an integer of from 1–4;

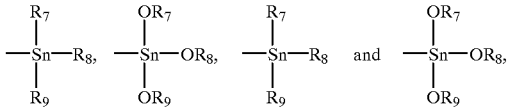

or two —(X—R)$_m$ groups are taken together to form divalent substituents of the formula

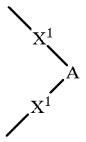

wherein each $X^1$ is independently selected from the group consisting of —O—, —S— and —N—$R_{10}$ and A is selected from the group consisting of ethylene, propylene, trimethylene, and such groups substituted with $C_1$–$C_4$ alkyl, $C_1$–$C_4$ alkoxy, cycloalkyl, 1,2-phenylene and 1,2-phenylene containing 1–3 substituents selected from $C_1$–$C_4$ alkyl, $C_1$–$C_4$ alkoxy and halogen;

n is an integer from 0–16; $n_1$ is an integer from 0–24, m is an integer from 0–16;

and $m_1$ is an integer from 0–24; provided that the sums of n+m and $n_1$+$m_1$ are 16 and 24, respectively;

$R_1$ and $R_2$ are independently selected from the group consisting of hydrogen, lower alkyl, lower alkoxy, halogen, aryloxy, lower alkylthio, arylthio, lower alkylsulfonyl; arylsulfonyl; lower alkylsulfonylamino, arylsulfonylamino, cycloalkylsulfonylamino, carboxy, unsubstituted carbonyl, substituted carbamoyl, sulfamoyl, lower alkoxycarbonyl, hydroxy, lower alkanoyloxy,

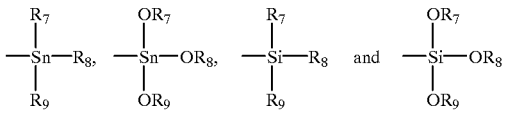

$R_3$ and $R_4$ are independently selected from the group consisting of hydrogen, lower alkyl, alkenyl and aryl.

21. A method of preparing a thermal paper having a base sheet, a base coat, top coat, back coat, a thermosensitive coating and near infrared fluorescent (NIRF) compound as a security measure which comprises:

a) incorporating a NIRF compound in solid micron size pigment particles to shield said NIRF compound from ambient air to prevent reaction with oxygen;

b) forming a layer of said solid micron size pigment particles on the base sheet of a thermal paper; and c) overcoating the layer of micron size pigment particles with a base coat or the thermosensitive coating of said thermal paper, wherein the amount of NIRF compound incorporated in the thermal paper is sufficient to be sensed by a photon detector operating in the near infra-red region of 675–2500 nm.

22. A method as in claim 21, wherein the NIRF compound is incorporated in micron size pigment particles by copolymerizing the NIRF compound with a monomer, oligomer or polymer of a polyester, polycarbonate or polyurethane, isolating the copolymer solid and grinding the copolymer solid to form micron size particles.

23. A method as in claim 22, wherein a layer of micron size pigment particles is formed on said base sheet by a flexographic printing method.

24. A method as in claim 21, wherein the solid micron sized pigment particles are comprised of a mixture of NIRF compounds and polymers selected from the group consisting of polyesters polycarbonates, polyurethanes and varnishes of synthetic and natural polymers.

25. A method of preparing a thermal paper having a base sheet, a base coat, top coat, backcoat, a thermosensitive coating and a near infrared fluorescent (NIRF) compound as a security measure which comprises:

a) incorporating a NIRF compound in a coating formulation for a thermosensitive coating, b) applying said coating formulation for a thermosensitive coating to a base sheet of a thermal paper, and c) shielding said NIRF compound from ambient air to prevent reaction with oxygen by either i) incorporating said NIRF compound within a solid pigment particle comprised of a polymer resin, ii) applying at least one protective coating over the thermosensitive coating within which the NIRF compound is incorporated, or iii) employing a combination of i) and ii).

* * * * *